United States Patent [19]

Sargent et al.

[11] Patent Number: 5,060,320

[45] Date of Patent: Oct. 29, 1991

[54] RECREATIONAL VEHICLE TOILET WITH FOOT PEDAL FLUSH

[75] Inventors: Charles L. Sargent; John M. Antos, both of Ann Arbor; David B. Cameron, Brighton, all of Mich.

[73] Assignee: Thetford Corporation, Ann Arbor, Mich.

[21] Appl. No.: 542,528

[22] Filed: Jun. 25, 1990

[51] Int. Cl.[5] ..... E03D 11/10

[52] U.S. Cl. ..... 4/438; 4/249

[58] Field of Search ..... 4/321, 432, 433, 434, 4/435, 438, 440, 441, 442, 249, 411, 413

[56] References Cited

U.S. PATENT DOCUMENTS

| | | | |
|---|---|---|---|
| 3,340,545 | 9/1967 | Sargent et al. | 4/435 |
| 3,369,260 | 2/1968 | Sargent et al. | 4/435 |
| 3,601,820 | 8/1971 | Sargent et al. | 4/435 |
| 3,883,903 | 5/1975 | Vander Broek et al. | 4/440 |
| 3,932,901 | 1/1976 | Inui et al. | 4/435 X |
| 4,185,340 | 1/1980 | Sargent et al. | 4/441 |
| 4,710,988 | 12/1987 | Stewart | 4/438 |
| 4,787,103 | 11/1988 | Endo | 4/441 |

*Primary Examiner*—Henry J. Recla
*Assistant Examiner*—Robert M. Fetsuga
*Attorney, Agent, or Firm*—Harness, Dickey & Pierce

[57] ABSTRACT

A toilet having a foot pedal flush control comprising two pedals, one for opening a toilet bowl discharge outlet and the other for supplying flush water to the bowl. The pedals both operate through actuation cables having a wire member slidable within a conduit. The flush water pedal can be independently actuated to partially fill the bowl prior to use of the toilet while the outlet closure member pedal coacts with the flush water pedal so that upon opening of the bowl outlet, the flush water pedal is depressed providing water to the bowl. The wire members are solid wire members coupled to the pedals for both pull and push operation so that upon a failure of the pedal return mechanism, the pedals can be manually returned closing the bowl outlet and terminating the flow of flush water to the bowl.

4 Claims, 5 Drawing Sheets

FIG 4
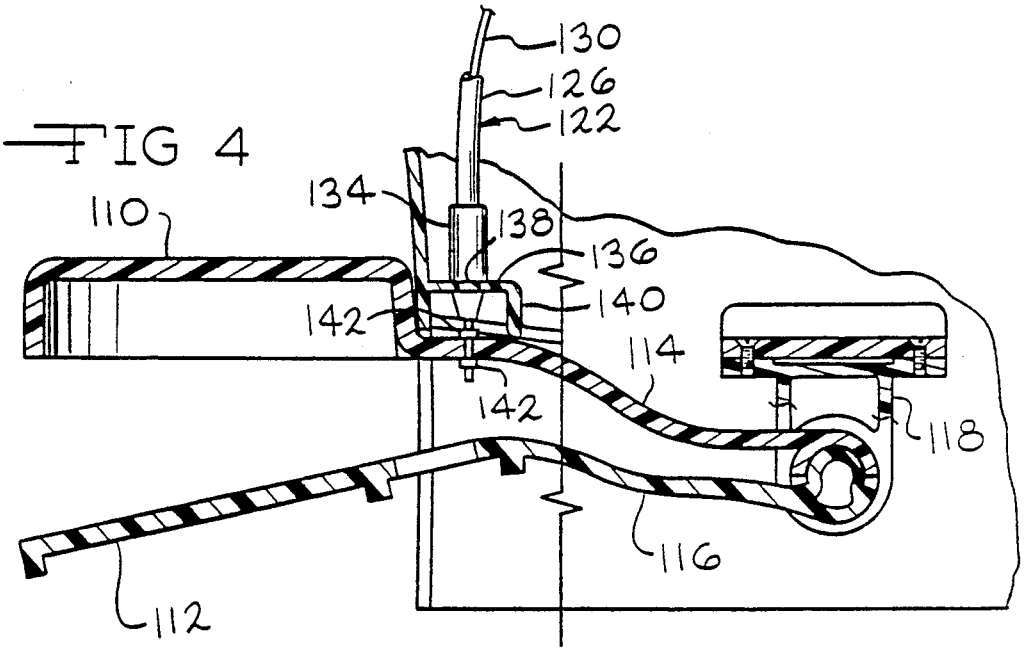
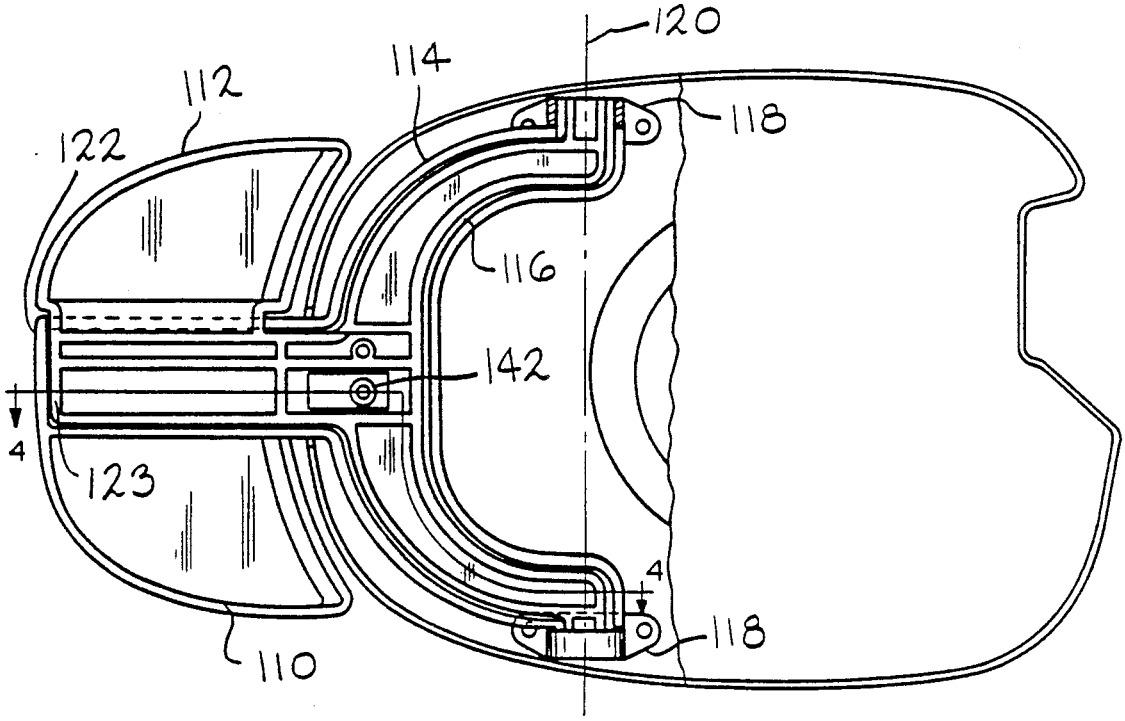
FIG. 3

RECREATIONAL VEHICLE TOILET WITH FOOT PEDAL FLUSH

BACKGROUND AND SUMMARY OF THE INVENTION

The present invention relates to improvements in the flush mechanism for toilets and in particular to toilets of the type where in the toilet bowl discharges to a holding tank and a closure member is provided for opening and closing the discharge outlet from the bowl to the holding tank. Toilets of this character are commonly used in mobile homes, recreational vehicles, marine vessels and the like.

A known toilet of the type to which the present invention relates is disclosed in U.S. Pat. No. 4,185,340, commonly assigned, the specification of which is hereby incorporated by reference. This patent discloses a toilet apparatus having a hand operated flush mechanism. The toilet disclosed in the referenced patent does not include a flush water storage tank located above the bowl with a flush actuator as in a typical residential toilet. As a result, the hand operated flush controls are located at the top of the bowl. This location requires the toilet user to stoop over the bowl to reach the controls. This may be difficult for elderly or handicapped persons and may also be an unpleasant task.

Accordingly, it is an object of the present invention to provide flush controls that are more convenient to operate.

The present invention provides a foot controlled flush mechanism for improving the ease by which the toilet is flushed. The hand operated flush control levers of the toilet disclosed in the referenced patent are replaced by wire actuated control levers that are operated by foot pedals. The pedals are pivotally mounted to the toilet housing at a position near the base of the toilet for easy operation by a toilet user without requiring stooping over the bowl.

Two pedals are provided, one for operating the flush water supply to the bowl and the other for operating the closure member at the bowl discharge outlet. The flush water pedal can be operated independently of the closure member pedal for use in partially filling the bowl with water before use of the toilet. After toilet use, the closure member pedal is actuated to open the bowl discharge outlet. The closure member pedal coacts with the water pedal to simultaneously actuate the water pedal to provide water for flushing.

The flush mechanism includes a return spring to automatically return the control levers to their normal positions when the foot pedals are released. It is a further object of the invention to provide a flush mechanism which, in the event of a failure of the return spring, enables the pedals to be manually raised to return the control levers to their normal positions.

Further objects, features and advantages of the invention will become apparent from a consideration of the following description and the appended claims when taken in connection with the accompanying drawings.

BRIEF DESCRIPTION OF THE DRAWINGS

FIG. 3 is a bottom view of the toilet apparatus of FIG. 1.

FIG. 4 is a sectional view as seen from substantially the line 4—4 of FIG. 3 with the water pedal depressed.

DETAILED DESCRIPTION OF THE INVENTION

Figure 1:
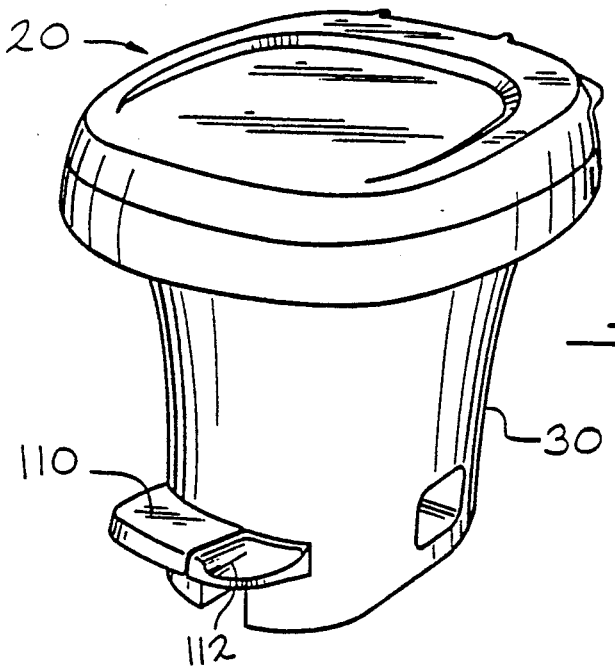
FIG. 1 is a perspective view of a toilet apparatus having foot pedal flush controls of the present invention.
Figure 2:
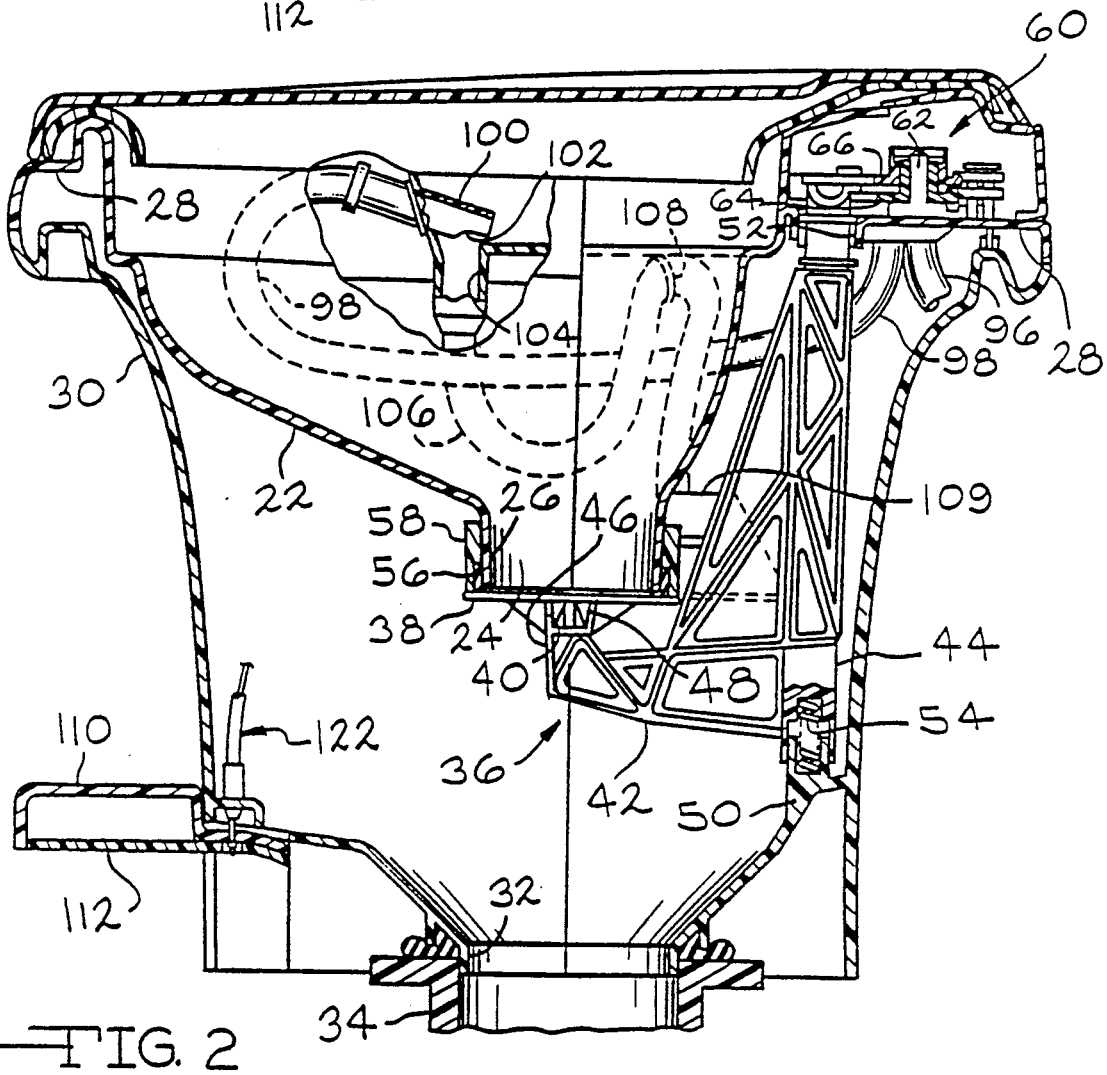
FIG. 2 is a vertical sectional view, with portions broken away for illustration, of the toilet apparatus shown in FIG. 1.

Referring to the drawings, the toilet of the present invention with foot pedal flush controls is shown in FIG. 1 and designated generally at 20. The toilet 20 comprises a bowl 22 having at its lower end a discharge outlet 24 defined by the downwardly projecting flange 26. The upper end of the bowl 22 is open and has an outwardly directed peripheral flange 28 that is supported on and is secured to a housing 30. The housing 30 defines an outlet 32 leading to a holding tank (not shown) via the conduit 34. Waste material from the bowl 22 can be discharged through the outlets 24 and 32 when the sealing mechanism 36 is in an open position.

Sealing mechanism 36 can be moved between open and closed positions for opening and closing the bowl outlet 24. Sealing mechanism 36 includes as a closure member the blade 38 having a downwardly opening socket 40 located centrally of the blade. The sealing mechanism also includes a crank arm 42 that has a shaft portion 44 providing an essentially vertical axis about which the crank arm 42 can pivot. The crank arm 42 has a finger 46 at its radially outer end for supporting the blade 38 surrounded by a collar 48 extending into the socket 40.

The shaft portion 44 is supported on the post 50 of the housing 30 and is guided for pivotal movement in the cylindrical bearing surface 52 of flange 28 which is integrally joined to housing 30. A coil spring 54 is positioned between the post 50 and the shaft portion 44 to urge crank arm 42 in an upward direction. Additional details of the blade 38 are provided in the referenced patent.

A seal member 56 is mounted in a sealing relationship to the bottom of the bowl 22 around outlet 24. The seal member 56 is an elastomeric sleeve which projects below the lower edge of the outlet 24 so as to provide an elastic curtain or a projecting portion below the lower edge of the flange. The seal member 56 is enclosed around its outer periphery by a collar 58 that is snap fit onto the bowl 22 around the outlet 24.

A control mechanism 60 is used for moving the sealing mechanism 36 to its open and closed positions and for supplying flush water to the bowl. A pivot member or post 62 is integrally formed with flange 28. Mounted on the post 62 for pivotal movement with respect thereto are the closure member control lever 64 and the flush water control lever 66. Closure member lever 64 includes a sleeve portion 68 telescoped over the pivot post 62 and has a radial bearing portion 70 at its upper end engaging the pivot post. The lower portion of the lever 64 engages a lower radial shoulder 72 of the pivot post to retain sleeve portion 68 concentric about the pivot post. The water lever 66 includes a sleeve portion 74 telescoped over the sleeve portion 68 of the lever 64 and also includes a bearing portion 76 engaging the sleeve portion 68 of the lever 64. A cylindrical bushing 78 is placed between the sleeve portions of the two levers to maintain the alignment of the two levers. The levers are held in place on the pivot post 62 by a washer 80 and screw 82.

The closure member lever 64 is operatively associated with the crank arm 42 to impart the movement required to move the blade 38 between the closed and open positions. For this purpose, the upper end of shaft portion 44 of crank arm 42 has a small crank arm 84. The small crank arm 84 has a raised cam follower 86 at its end for traveling in slot 88 in the lever 64. Slot 88 is generally dog legged in shape having a first primarily circumferentially directed portion 89 and a second portion 90 having a substantial radially directed component. The slot 88 is shaped so that when the lever 64 is moved clockwise from a position shown in FIG. 5, the small crank arm 84 will not change its radial position while the cam follower travels through the first portion 89 of the slot. When the lever 64 is advanced further in the clockwise direction, the cam follower 86 will travel in the second portion 90 of slot 88 to the position of FIG. 11. While the cam follower 86 travels through the second portion of the slot, the crank arm 42 will be pivoted from the closed position to the open position shown in FIG. 11. When the closure member lever 64 is returned to its position of FIG. 5, the crank arm 42 will be moved in a reverse order of that described above. This reverse order motion will return the blade 38 to the closed position.

Figure 5:
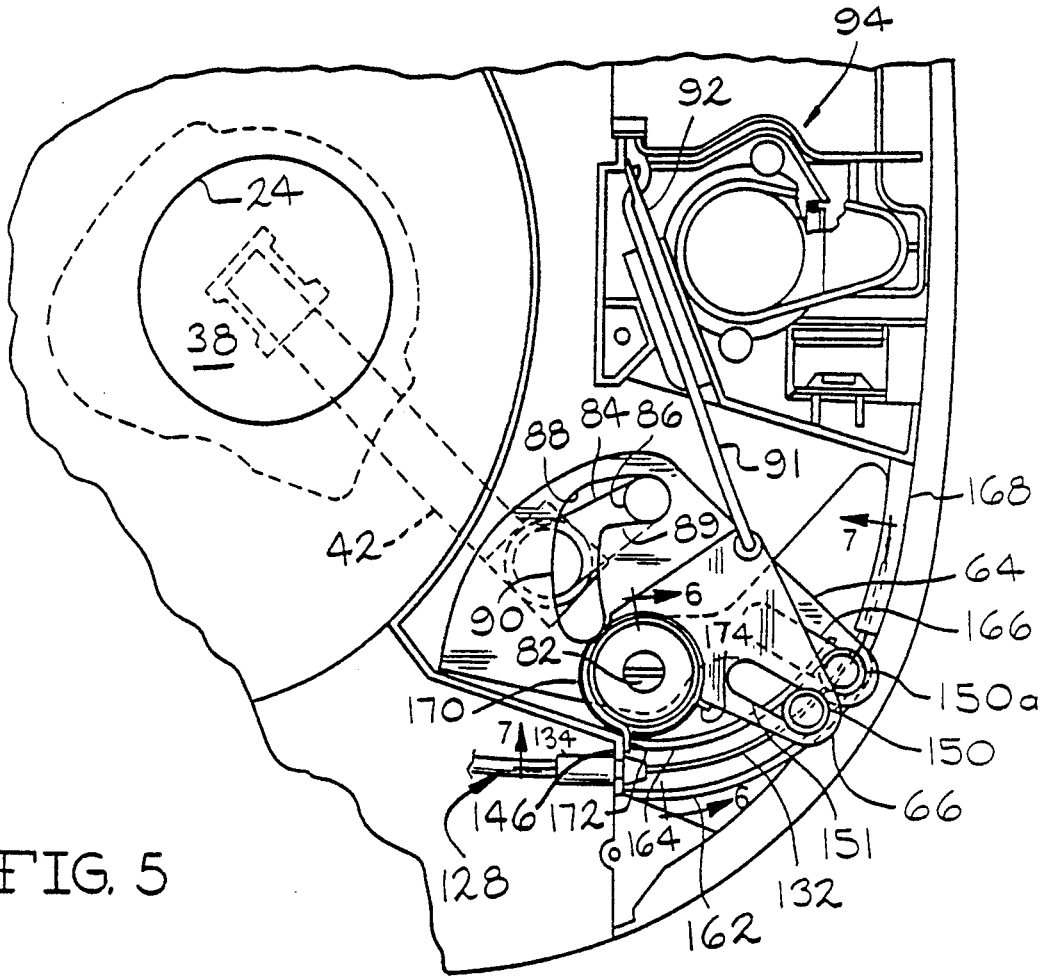
FIG. 5 is an enlarged fragmentary plan view of the flush control mechanism with the water control levers in closed positions.

Water is provided to the bowl for flushing upon actuation of the water lever 66. As will be described in greater detail below, water lever 66 can be independently actuated to provide water for partially filling the bowl 22. Water lever 66 is automatically actuated upon actuation of the closure member lever 64 so as to provide water to the bowl for flushing when the blade 38 is moved to the open position. Water lever 66 has one end of a linkage 91 connected thereto as shown in FIG. 5. The other end of the linkage 91 is connected to a crank 92 of a water flow control valve assembly 94. Control valve assembly 94 includes an inlet fitting (not shown) for connection to an external source of water through hose 96. The control valve assembly 94 includes an outlet and flush tube 98 for directing water to the nozzle 100. When the water lever 66 is pivoted in a clockwise direction, the crank 92 will also pivot, opening the control valve assembly allowing water to flow from the source of supply into the flush tube 98 and from there to nozzle 100.

The nozzle 100 is mounted in the bowl 22 to direct a jet of water into the bowl for flow in a vortex pattern. The nozzle has a small aperture 102 therein to allow small quantities of water to descend during flushing into the overflow drain outlet 104 so as to maintain water in the overflow tube 106. The tube 106 is supported adjacent to its mid-portion by a hook 108 which is mounted in the bowl 22 so as to provide a water trap to prevent odors, gases and the like escaping from the regions below the bowl 22 through the overflow tube 106. The latter has its lower end terminating in the enclosure 109 so that limited quantities of water that flow from the overflow tube can drop onto the top of blade 38 while it is in its open position as described in greater detail in the referenced patent.

The closure member lever 64 and water lever 66 are actuated by two pedals, a closure member pedal 110 and a flush pedal 112. Pedals 110 and 112 are pivotally mounted to the housing 30 adjacent the lower end of the housing as shown in FIGS. 1–4. The pedals 110 and 112 are integrally formed with U-shaped mounting arms 114 and 116 respectively. The terminal ends of the mounting arms are pivotally connected to the housing 30 through mounting brackets 118 fastened to the housing 30 on opposite sides. The two mounting brackets define an axis 120 about which both pedals pivot. A portion 122 of pedal 110 overlies a portion 123 of the pedal 112. Likewise, the mounting arm 114 of pedal 110 overlies the mounting arm 116 of pedal 112. Downward rotation of the closure member pedal 110 also rotates the water pedal 112 due to the overlying relation of pedal 110 to pedal 112. However, the pedal 112 can be rotated downwardly independent of the pedal 110 by foot pressure applied solely to the pedal 112. FIG. 4 shows the water pedal 112 in a downwardly rotated position while pedal 110 remains in its normal position.

The closure member pedal 110 and the flush water pedal 112 are connected to the levers 64 and 66 respectively through actuating wire assemblies 122 and 124 respectively. Actuating wire assemblies 122 and 124 include conduits 126 and 128 respectively and solid wires 130 and 132 respectively which are longitudinally slidable within the conduits. The ends of the wire assemblies include fittings 134 for attaching the conduits to the housing 30.

At the pedal end of the wire assemblies, a flange 136 extends inwardly from the housing and includes a slotted opening 138 into which an end fitting 134 is snap-fit to secure the wire assembly 122 thereto. A downturned portion 140 of the flange 136 serves as a stop to limit the upward rotation of pedals 110 and 112. With reference to FIG. 4, the end of the closure member wire 130 is shown attached to closure member pedal 110 by retainer clip 142 sandwiching the pedal therebetween. The clip 142 is used to enable both pushing and pulling of the wire 130 through conduit 126 as will be described below.

The opposite ends of the wire assemblies 122 and 124 are snap-fit into slotted openings 142 and 144 in the upturned flange 146 extending from the bowl periphery flange 28. Connection of the wire assemblies to the control levers is described below with reference to connection of the water wire 132 to the Water control lever 66.

A small diameter ball 148 is pressed onto the wire 132. A hollow guide pin 150 is inserted through slot 151 in the water lever 66 and over the wire 132 and ball 148. The guide pin 150 includes two longitudinal slots 152 which enable the guide pin to be fitted over the ball and wire. The slots 152 form two fingers 154 in the guide pin 150 which can be resiliently deflected. Each of the fingers 154 includes a window 156.

After the guide pin 150 has been inserted over the ball 148, a retainer 158 is inserted into the guide pin through the open lower end. Retainer 158 includes two projecting tabs 160 on opposite sides. As the retainer is inserted into the guide pin, the tabs 160 deflect the fingers 154 outwardly until the retainer has been inserted far enough into the guide pin to align the tabs with the windows 156. The fingers 154 are then allowed to return to their normal state, seating tabs 160 in the windows to lock retainer 158 in place. The ball 148 is thus captured in the guide pin 150 causing the guide pin to be moved with movement of the wire 132 and ball 148.

Figure 6:
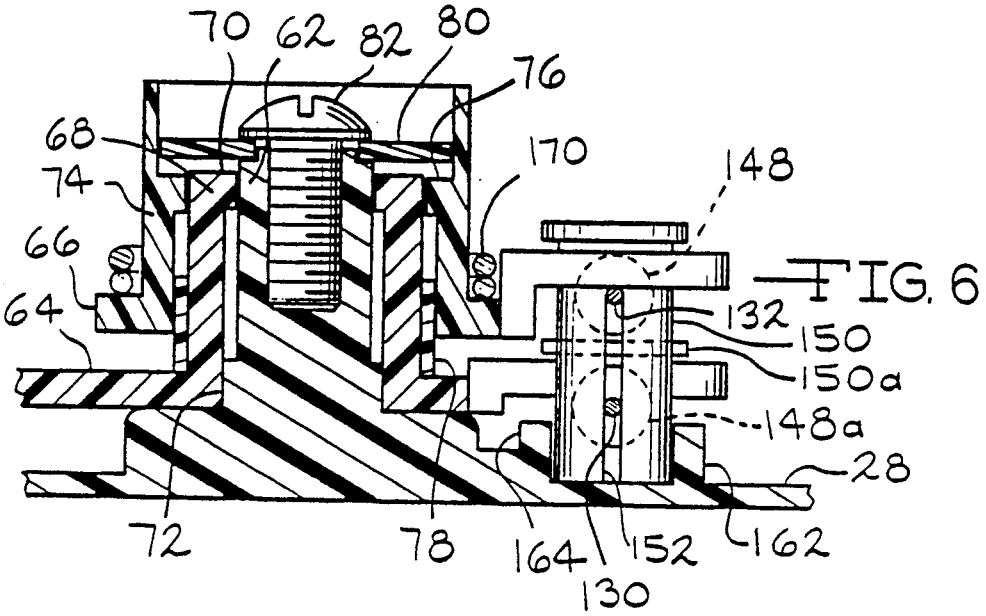
FIG. 6 is a sectional view of the control mechanism as seen from substantially the line 6—6 of FIG. 5.
Figure 7:
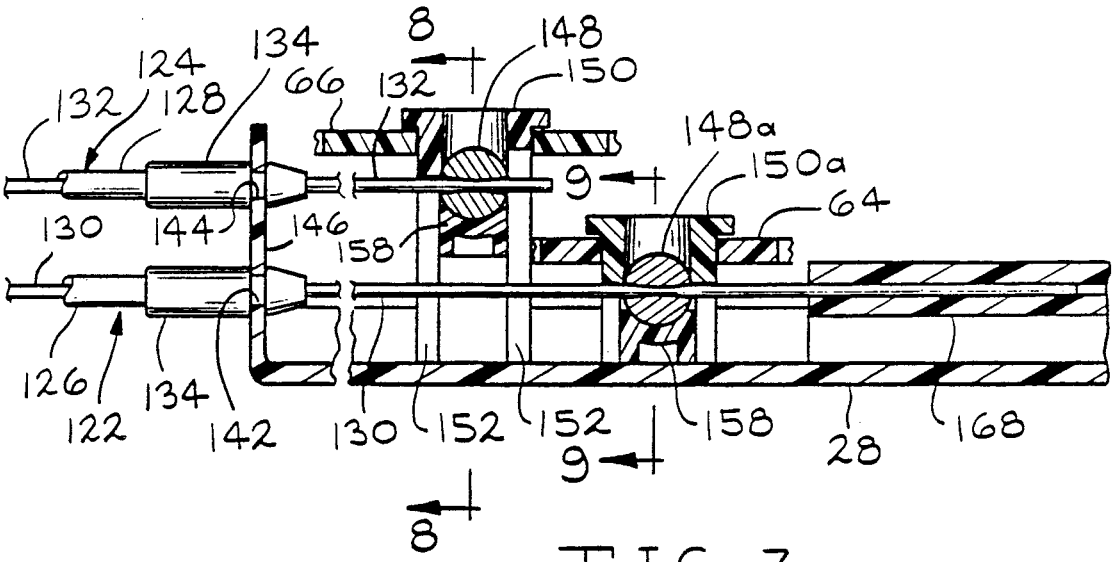
FIG. 7 is a sectional view of the control mechanism as seen from substantially the line 7—7 of FIG. 5.
Figure 8:
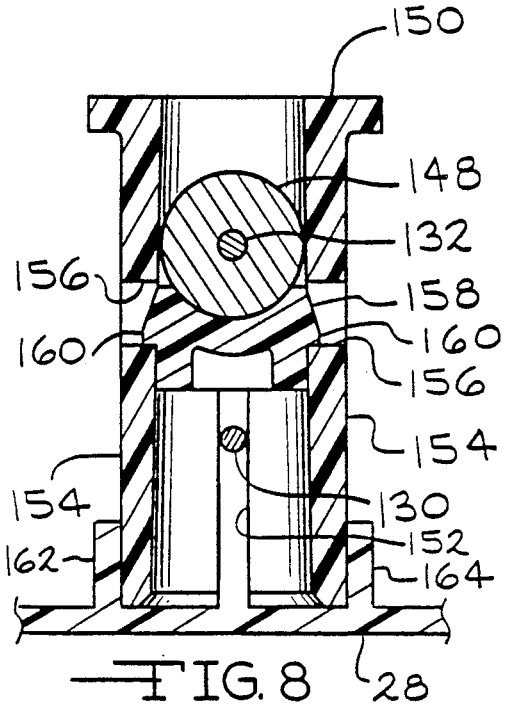
FIG. 8 is a sectional view of the control mechanism as seen from substantially the line 8—8 of FIG. 7.
Figure 9:
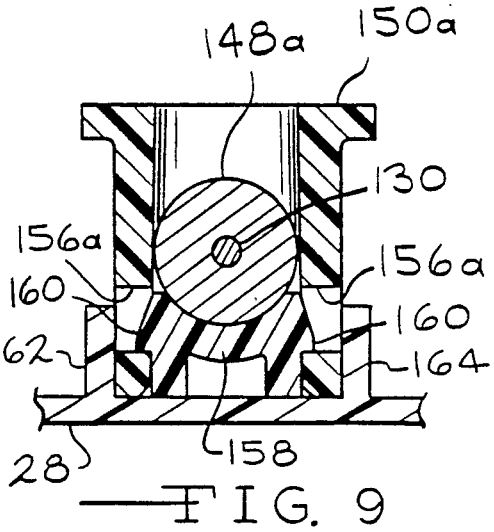
FIG. 9 is a sectional view of the control mechanism as seen from substantially the line 9—9 of FIG. 7.

With reference to FIGS. 5 and 6, it is seen that the flange 28 includes two raised parallel arcuate track members 162 and 164. The guide pin 150 is positioned between the two track members 162 and 164 so that as the guide pin is moved, it follows the arcuate path defined by the two track members. Slot 151 is provided in the water lever 66 for the guide pin 150 to travel in because the arcuate path defined by the track members 162 and 164 is not concentric about the pivot post 62. The arcuate path is not concentric with post 62 to avoid bending wire 132 on a smaller radius than which it can be easily bent.

Figure 10:
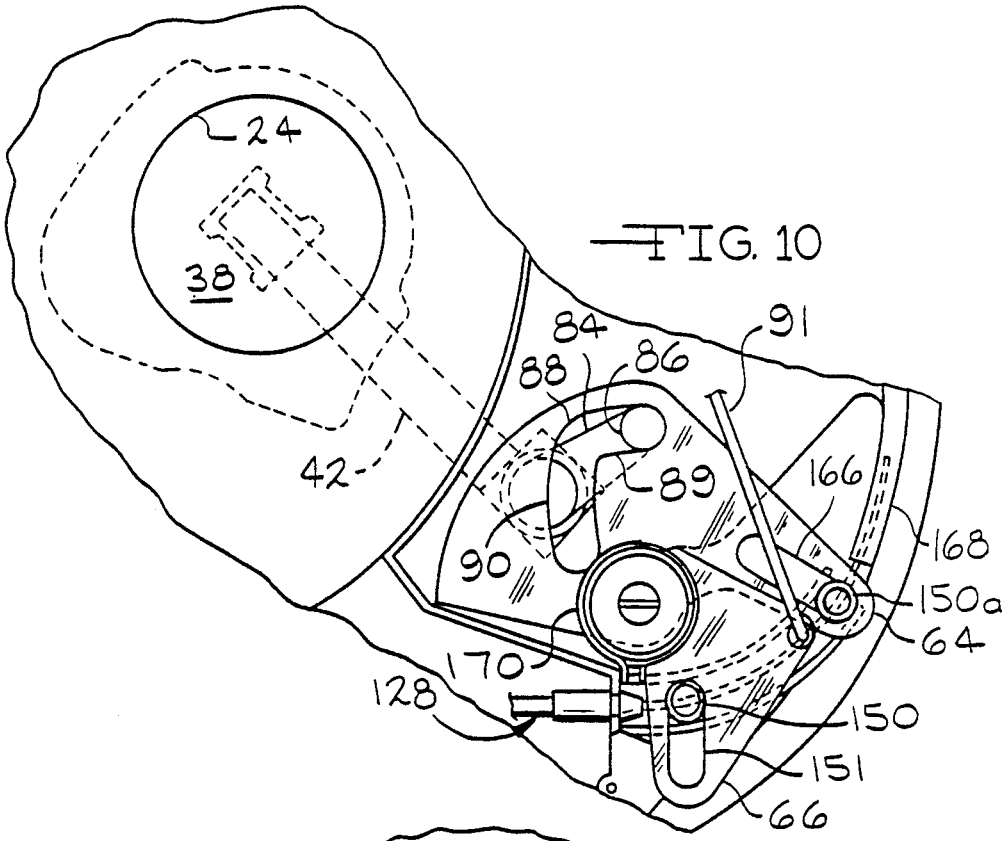
FIG. 10 is an enlarged fragmentary plan view of the control mechanism with the water lever rotated to an open position.
Figure 11:
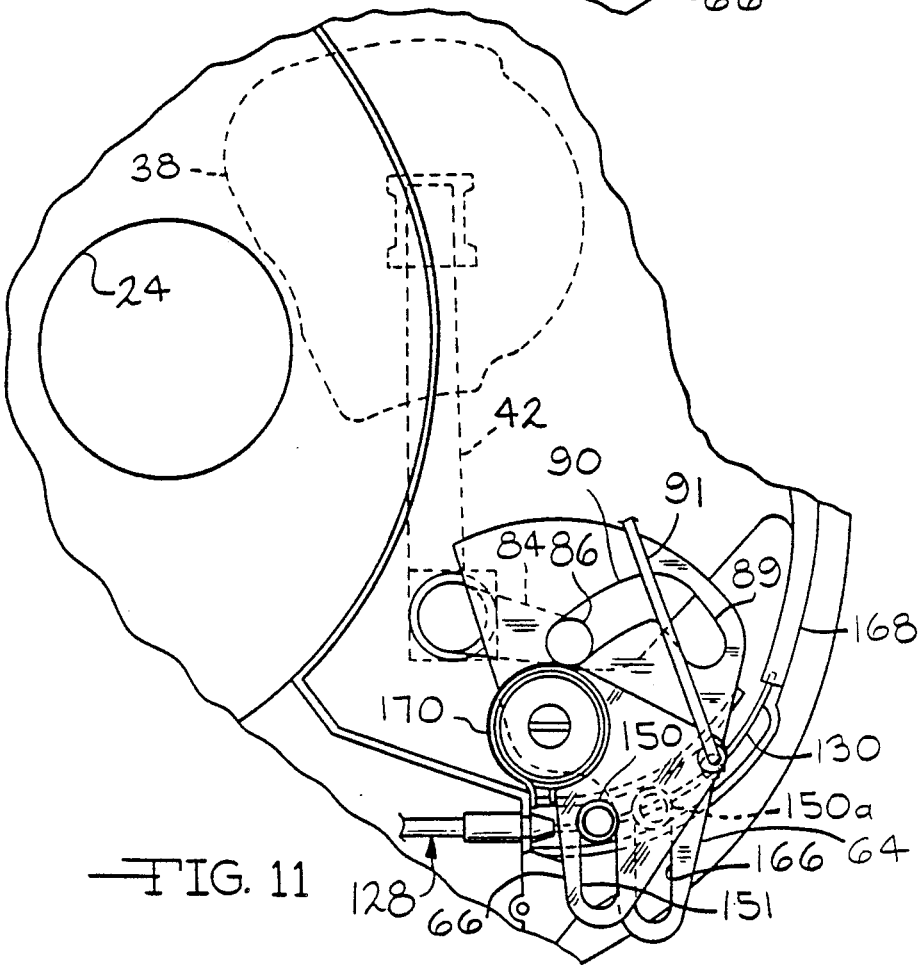
FIG. 11 is a view similar to FIG. 10 with both the levers in open positions.

Upon depression of the water pedal 112, the wire 132 will rotate the water lever 66 in a clockwise direction as viewed in FIG. 5. As the lever 66 rotates, the guide pin 150 will travel through slot 151 to the opposite end as shown in FIGS. 10 and 11. This clockwise rotation of the water lever 66 will in turn pull linkage 91, operating crank 92 of the water flow control valve assembly 94 to open the valve assembly, allowing water to flow into the toilet bowl 22.

The wire 130 in closure member wire assembly 122 is connected to the closure member lever 64 by a similar guide pin **150*a* which is identical to guide pin 150 except for a shorter vertical height. Portions of guide pin 150*a* and the wire connection that are similar to portions of guide pin 150 and its wire connection are designated by the same reference numeral followed by the suffix "a". Guide pin 150*a* also follows the arcuate path of track members 162 and 164. Accordingly, the closure member lever 64 includes a slot 166 similar to slot 151 in control lever 66. During clockwise rotation of the lever 64, the guide pin 150*a* travels through slot 166 from the position shown in FIG. 5 to that of FIG. 11. Wire 130 extends beyond the guide pin 150*a* into a wire guide 168 to help ensure the proper radius bend in the portion of wire 130 extending from conduit 126**.

A torsion spring 170 is placed over the sleeve portion 74 of the water lever 66 for use in biasing the water lever to the closed position of the control valve assembly 94. Spring end 172 engages the flange 146 while the other spring end 174 engages the water lever 66. Clockwise rotation of the water lever 66 increases the torsional stress in spring 170 such that when the water pedal is released, the spring will return water lever 66 to the position shown in FIG. 5 in which the control valve assembly 94 is closed. The return of water lever 66 will pull on wire 132 raising the water pedal 112.

Upon depression of the closure member pedal 110, the water pedal 112 is also depressed so that both water lever 66 and closure member lever 62 are rotated clockwise to the positions shown in FIG. 11, opening the discharge outlet of the bowl and providing water to the bowl for flushing. Upon release of the flush pedal 110, the torsion spring 170 will act upon the water lever to return it to the position of FIG. 5. In so doing, the guide pin 150 will engage the edge of lever 64 returning the lever 64 to the closed position of FIG. 5 also. Contact of the closure member lever 66 with guide pin 150 also causes the water lever 66 to rotate when closure member pedal 110 is depressed. The spring induced rotation of the two levers will pull upon the two wires 130 and 132 so as to raise the pedals 110 and 112 to their initial positions.

The fixed coupling of the two wires to their respective pedals and to the guide pins enables both pushing and pulling of the wire. In the event the spring 170 fails, lifting of the pedals will act to push the wires through their conduits to return the levers to the positions closing the toilet bowl outlet and the water flow control valve assembly 94. The toilet is thus provided with fail safe operating means for both opening and closing the bowl outlet and the flush water supply. Wires 130 and 132 are solid wires to provide sufficient strength to accommodate compression loads necessary to push on the wires to return levers 64 and 66.

The toilet is thus provided with foot pedal flush controls for easier operation not requiring the user to stoop over the bowl. The connection of the pedals to the flush and water levers enables the pedals to be used to close the bowl outlet and water valve assembly in the event the return spring fails.

It is to be understood that the invention is not limited to the exact construction illustrated and described above, but that various changes and modifications may be made without departing from the spirit and scope of the invention as defined in the following claims.

We claim:

1. Toilet apparatus with foot pedal flush comprising a housing, a toilet bowl mounted on said housing and having an outlet at its lower end and a closure member movable between positions opening and closing said outlet, and flush water supply means including a discharge nozzle operatively associated with said bowl for supplying flush water to the upper end of the bowl, the improvement comprising foot pedal apparatus mounted on said housing for movement in up and down directions, a closure member control lever and a flush water control lever both rotatably mounted to said housing, said closure member control lever coupled to said closure member for moving said closure member to said open position in response to rotation of said closure member control lever in a first direction, said flush water control lever coupled to said flush water supply means for opening said supply means to supply flush water to said bowl in response to rotation of said flush water control lever in said first direction, a pair of flexible control wires contained in conduits mounted to said housing for sliding movement therein with the proximal and distal ends of said wires extending from the ends of said conduits, the proximal ends of said wires being coupled to said foot pedal apparatus with the distal end of one of said wires connected to said closure member control lever through a first guide pin and the distal end of the other of said wires connected to said flush water control lever through a second guide pin for rotation of said control levers in said first direction upon tension applied to said wires in response to downward depression of said pedal apparatus, bias means for returning said closure member to the closed position and closing said flush water supply means upon release of said pedal apparatus by rotating said control levers in a second direction opposite to said first direction, said flexible control wires being solid element wires of sufficient stiffness whereby compression of said wires by manual raising of said foot pedal apparatus causes said control levers to rotate in a second direction in the event of a failure of said bias means.

2. Toilet apparatus according to claim 1 wherein said foot pedal apparatus comprises a pair of side-by-side foot pedal members, one of which is connected to said flush water control lever so that downward movement of said one pedal member results in rotation of the flush water control lever in said first direction causing supply of flush water to the bowl and the other pedal is connected to said closure member control lever so that downward movement of said other pedal member causes rotation of the closure member control lever in said first direction to move said closure member to said open position.

3. Toilet apparatus according to claim 2 wherein said foot pedal connected to said flush water control lever coacts with the pedal connected to the closure member control lever so that downward movement of the last mentioned pedal results in downward movement of the other pedal.

4. Toilet apparatus with foot pedal flush comprising a housing, a toilet bowl mounted on said housing and having an outlet at its lower end and a closure member movable between positions opening and closing said outlet, and flush water supply means including a discharge nozzle operatively associated with said bowl for supplying flush water to the upper end of the bowl, a closure member foot pedal pivotally mounted on said housing, a flush water foot pedal pivotally mounted on said housing, a closure member control lever and a flush water control lever both rotatably mounted to said housing about a common pivot, said closure member control lever being coupled to said closure member for moving said closure member to said open position in response to rotation of said closure member control lever in a first direction, said flush water control lever being coupled to said flush water supply means for operating said supply means to supply flush water to said bowl in response to rotation of said flush water control lever in said first direction, a pair of flexible control wires contained in conduits mounted to said housing for sliding movement therein with the proximal and distal ends of said wires extending from the ends of said conduits, the proximal ends of said wires being coupled to said foot pedals with the distal end of one of said wires being coupled to said closure member control lever through a first guide pin and the distal end of the other of said wires coupled to said flush water control lever through a second guide pin for rotation of said levers in said first direction upon tension applied to said wires in response to downward depression of said pedals, bias means for returning said closure member to the closed position and closing said flush water supply means upon release of said pedals by rotating said control levers in a second direction opposite to said first direction, said flexible control wires being solid element wires of sufficient stiffness whereby compression of said wires by manually raising said foot pedals causes said levers to rotate in said second direction in the event of failure of said bias means, said guide pins moving in an arcuate path formed by tracks in said housing in response to pulling by said wires, said arcuate path being eccentric about said pivot and said guide pins extending through slots formed in said closure member control lever and said flush water control lever along which slots said guide pins travel as said guide pins move through said arcuate path.

* * * * *